US007455197B2

(12) United States Patent
Ophardt

(10) Patent No.: US 7,455,197 B2
(45) Date of Patent: Nov. 25, 2008

(54) SINK SIDE TOUCHLESS FOAM DISPENSER NOZZLE ASSEMBLY

(75) Inventor: Heiner Ophardt, Vineland (CA)

(73) Assignee: Gotohti.com Inc., Beamsville, Ontario (CA)

( * ) Notice: Subject to any disclaimer, the term of this patent is extended or adjusted under 35 U.S.C. 154(b) by 0 days.

(21) Appl. No.: 11/980,713

(22) Filed: Oct. 31, 2007

(65) Prior Publication Data

US 2008/0121660 A1 May 29, 2008

Related U.S. Application Data

(63) Continuation-in-part of application No. 10/928,099, filed on Aug. 30, 2004.

(30) Foreign Application Priority Data

Jul. 14, 2004 (CA) ..... 2474178

(51) Int. Cl.
*B67D 5/58* (2006.01)

(52) U.S. Cl. ..... 222/190; 222/132; 222/135; 222/145.5; 4/623

(58) Field of Classification Search ..... 222/190, 222/145.5, 145.6, 145.7, 145.8, 52, 181.1, 222/135, 132, 63; 4/623–624, 675–678, 4/628; 251/129.04; 137/801
See application file for complete search history.

(56) References Cited

U.S. PATENT DOCUMENTS 2,772,116 A * 11/1956 Dobkin ..... 222/190
3,625,858 A 12/1971 Conn
4,620,983 A 11/1986 Zimmer
4,830,737 A 5/1989 Cole, Jr.
5,087,352 A 2/1992 Cole, Jr.
5,165,577 A 11/1992 Ophardt
5,271,530 A 12/1993 Uehira et al.
5,310,093 A * 5/1994 Bennett ..... 222/190
5,356,051 A 10/1994 Azuma et al.
5,392,965 A 2/1995 Azuma et al.
5,423,461 A 6/1995 Azuma et al.
5,445,288 A 8/1995 Banks
5,540,362 A 7/1996 Azuma et al.
5,544,788 A 8/1996 Meyer
5,836,482 A 11/1998 Ophardt et al.
5,842,607 A 12/1998 Snider
5,960,991 A 10/1999 Ophardt
6,082,586 A 7/2000 Banks
6,161,726 A 12/2000 Parsons et al.
6,206,238 B1 3/2001 Ophardt
6,409,050 B1 6/2002 Ophardt et al.
6,446,840 B2 9/2002 Ophardt et al.
6,601,736 B2 8/2003 Ophardt et al.
2005/0258192 A1 11/2005 Matthews et al.

FOREIGN PATENT DOCUMENTS

EP 533983 A1 10/1998
WO WO 88/07895 10/1988

* cited by examiner

*Primary Examiner*—Frederick C. Nicolas
(74) *Attorney, Agent, or Firm*—Riches, McKenzie & Herbert LLP

(57) ABSTRACT

A soap dispenser, preferably a sink side counter mounted dispenser, to dispense foamed liquid soap by mixing in an outlet of a soap spout liquid, soap and air preferably provided from a liquid soap pump and a air pump located remote from the faucet.

15 Claims, 9 Drawing Sheets

SINK SIDE TOUCHLESS FOAM DISPENSER NOZZLE ASSEMBLY

RELATED APPLICATIONS

This application is a continuation-in-part of U.S. patent application Ser. No. 10/928099 filed Aug. 30, 2004.

SCOPE OF THE INVENTION

The present invention relates to a sink side soap dispenser for producing foam.

BACKGROUND OF THE INVENTION

It is known to provide hand washing stations, such as in washrooms, where a faucet distributes water into a sink and soap dispensers are provided proximate the sink to dispense soap. Such soap dispensers may be mounted on a wall adjacent the sink or be mounted at the sink's side as on a countertop carrying the sink. Some sink side soap dispensers are manually operated and others are automatically operated as with sensors such that they dispense soap automatically in a touchless manner on the sensor sensing the presence of a user's hand proximate the soap dispenser and dispensing soap by activation of an automatic soap pump.

While soap dispensers are known which dispense soap, previously known automatic soap dispensers, particularly sink side soap dispensers, do not provide an arrangement for touchless dispensing of foamed soap at sink side locations.

SUMMARY OF THE INVENTION

To at least partially overcome these disadvantages of the previously known devices, the present invention provides a dispenser, preferably a sink side counter mounted soap dispenser, to dispense foamed liquid by mixing in a spout, outlet liquid and air preferably provided from a liquid pump and an air pump located remote from the spout. The dispenser is preferably adapted for automatic dispensing by an activation switch and may preferably be a touchless switch which is activated by sensing the proximity of a person's hand near the outlet nozzle of the spout.

In one aspect, the present invention provides a foam dispenser comprising: a nozzle mounted at a dispensing location carrying a foaming device, an air inlet tube with an outlet and an inlet, an air pump remote from the nozzle operative to dispense air from the pump into an inlet to the air input tube through the outlet of the tube and into the foaming device, a liquid inlet tube with an outlet and an inlet, a liquid reservoir remote from the nozzle, a liquid pump operative to dispense fluid from the reservoir into the inlet to the liquid inlet tube through the tube to the outlet and into the foaming device, and preferably, including actuating means, activable to operate both the air pump and liquid pumps and, simultaneously, pass air and liquid through the foaming device. The liquid reservoir is remote from the nozzle and may be provided some distance from the nozzles as, for example, with the liquid pump and air pump hidden from view to a person receiving foamed liquid from the nozzle.

In another aspect, the present invention provides a soap dispenser providing a sink side foamed soap spout proximate a sink with pump mechanisms for pumping air and liquid soap disposed at a remote location and directed to the spout through feed tubes. Preferably, a liquid soap pump is connected to a reservoir and operative to direct liquid soap through a liquid soap feed tube to the soap spout. An air pump may be provided to provide air to the spout by an air feed tube. The air pump preferably is located remote from the spout although it could be incorporated proximate to the spout or possibly internally thereof. The reservoir for the liquid soap and the liquid pump preferably are located close to each other with the liquid pump to push the liquid soap the distance to the spout. The reservoir and liquid pump may be located a considerable distance from the spout.

The foamed soap spout is preferably adapted for automatic dispensing either by manual activation of a switch or, preferably, by automatic operation in a touchless manner by reason of conventionally known sensors being provided to sense the proximity of the user's hand near the soap spout.

The present invention also provides a foam generator to receive air and liquid and mix the same for dispensing of foam.

In another aspect, the present invention provides a convertible dispenser spout for dispensing either liquid or a foamed mixture of air and liquid, the spout comprising:

a chamber forming member defining a chamber therein having an interior, an exit port, an air inlet port adapted to be connected to a source of air above atmospheric pressure, and a liquid inlet port adapted to be connected to a source of liquid above atmospheric pressure, the chamber forming member comprising an inner portion and an outer portion, the outer portion removably coupled to the inner portion for removal to access the interior of the chamber, the exit port carried on the outer portion, the air inlet port and the liquid inlet port carried on the inner portion, a foam producing member adapted to be removably received in the interior of the chamber across the exit port by being sandwiched between the inner portion and the outer portion when they are coupled together, the foam producing member being insertable into and removable from the chamber when the inner portion and an outer portion are uncoupled from each other, the foam producing member adapted when liquid and air are simultaneously passed therethrough to produce foam, a valve mechanism disposed across the air inlet port adapted to assume either a closed configuration in which the valve mechanism blocks flow through the air inlet port and an open configuration in which the valve mechanism permits flow through the air inlet port, the valve mechanism selected from: (a) a one way valve resiliently biased to assume the closed configuration and which assumes the open configuration when air at a pressure above the pressure in the chamber is applied to the air inlet port, and (b) a stop member adapted to be removably received in the interior of the chamber across the air inlet port wherein in the closed configuration the stop member is retained in the chamber across the air inlet port by being sandwiched between the inner portion and the outer portion when they are coupled together and in the open configuration the stop member is not present in the chamber, the stop member being insertable into and removable from the chamber when the inner portion and an outer portion are uncoupled from each other.

The present invention provides for foamed dispensing of a variety of liquids including soaps, cleaners, disinfectants, hand creams, sun block, insect repellent and various food products such as cream, milk, syrups and the like.

BRIEF DESCRIPTION OF THE DRAWINGS

Further aspects and advantages of the present invention will become apparent from the following description taken together with the accompanying drawings in which.

DETAILED DESCRIPTION OF THE DRAWINGS

Figure 1:
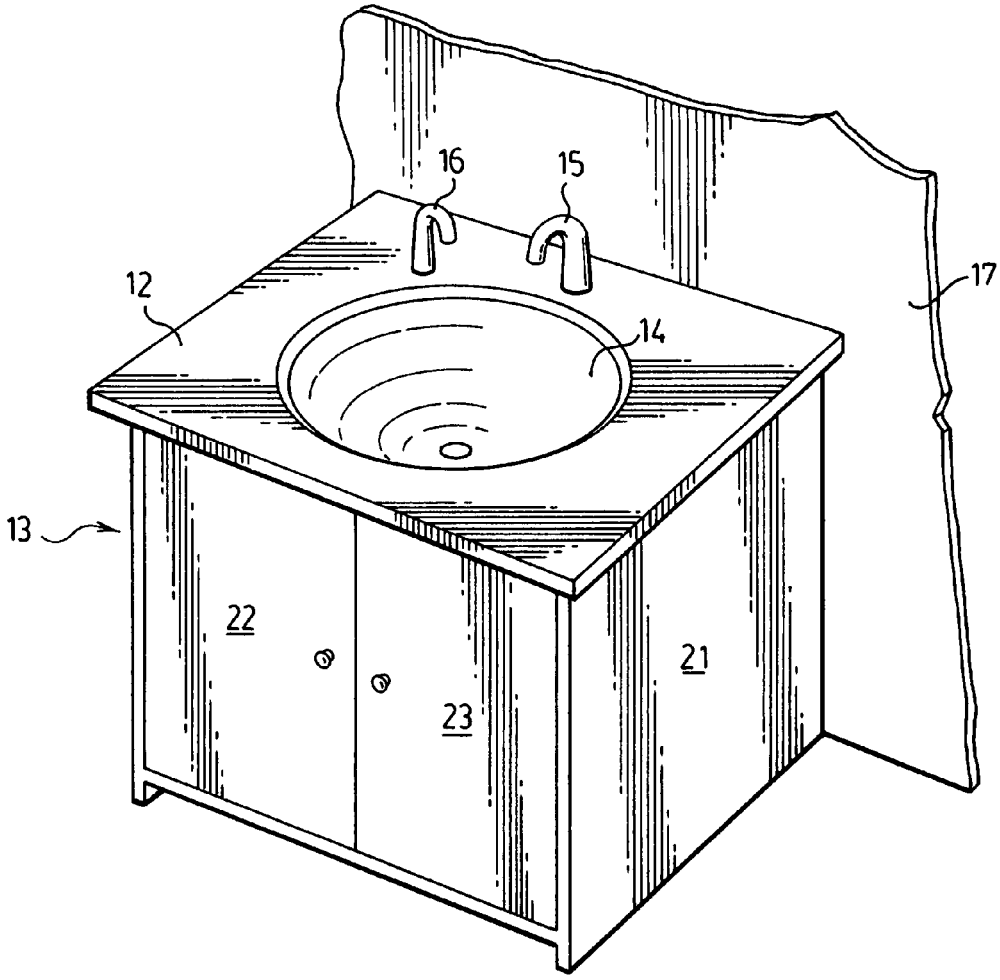
FIG. 1 is a pictorial view of a washroom counter mounted sink with a single foamed soap dispenser in accordance with the first embodiment of this invention.

FIG. 1 illustrates a typical hand washing station as in a washroom comprising a countertop 12 supported on a cabinet base 13 adjacent a room wall 17.

Figure 2:
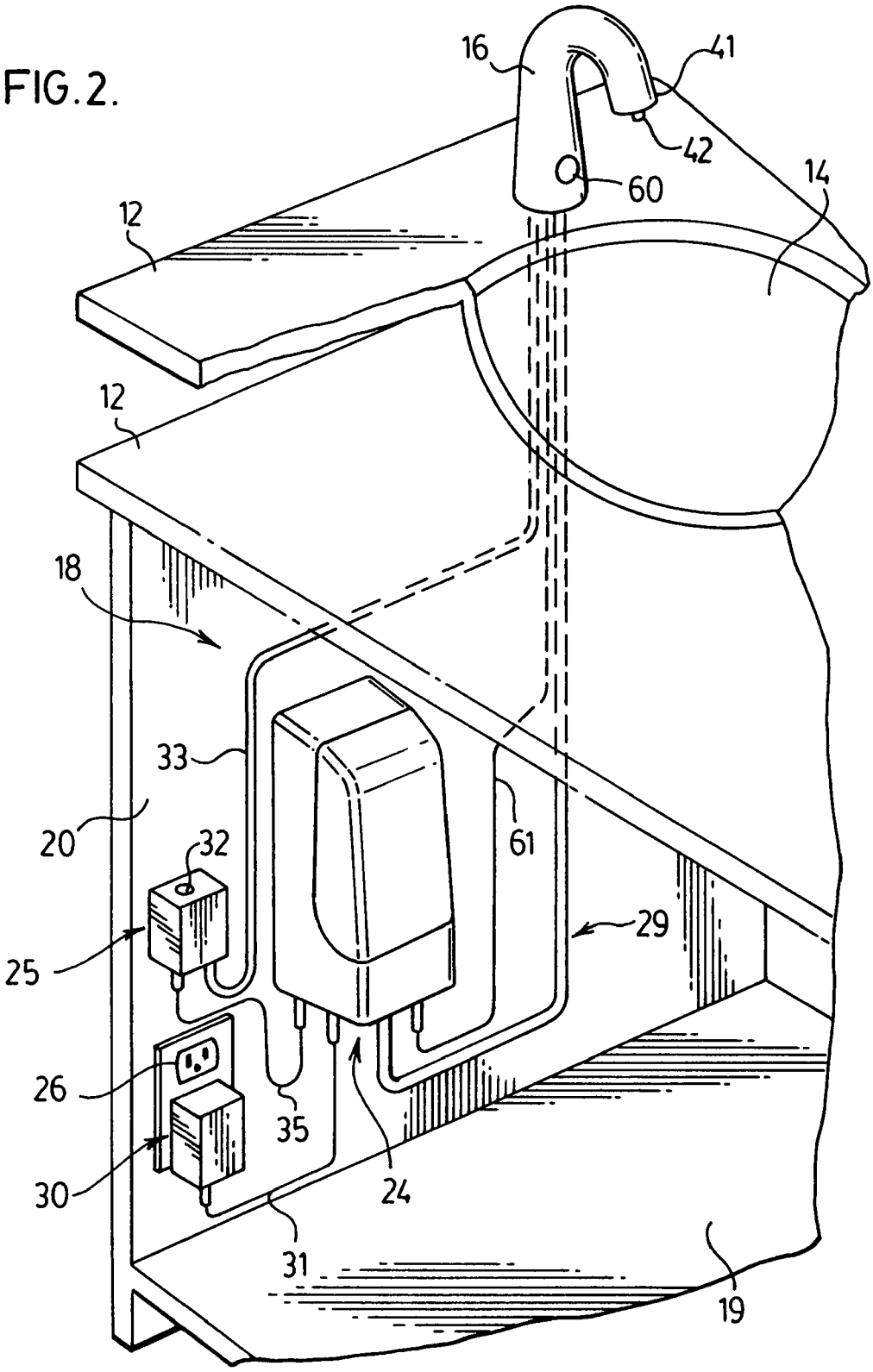
FIG. 2 is a schematic pictorial view of the soap dispenser shown in FIG. 1.

A sink 14 is mounted in the countertop with a water dispensing faucet 15 mounted to expend upwardly from the countertop at the rear of the sink and a soap dispensing spout 16 mounted to extend upwardly from the countertop 12 adjacent one side of the sink 14. Referring to FIGS. 1 and 2, the cabinet base 13 has a storage compartment 18 under the countertop 12 defined under the countertop 12 between the countertop 12 and a base shelf 19 and between the side walls 20 and 21 with access to the compartment 18 being via doors 22 and 23 only shown in FIG. 1.

Referring to FIG. 2, mounted within the storage compartment 18 on one side wall 20 are an automatic soap dispenser 24, an air pump 25 and an A/C electrical outlet 26.

Figure 5:
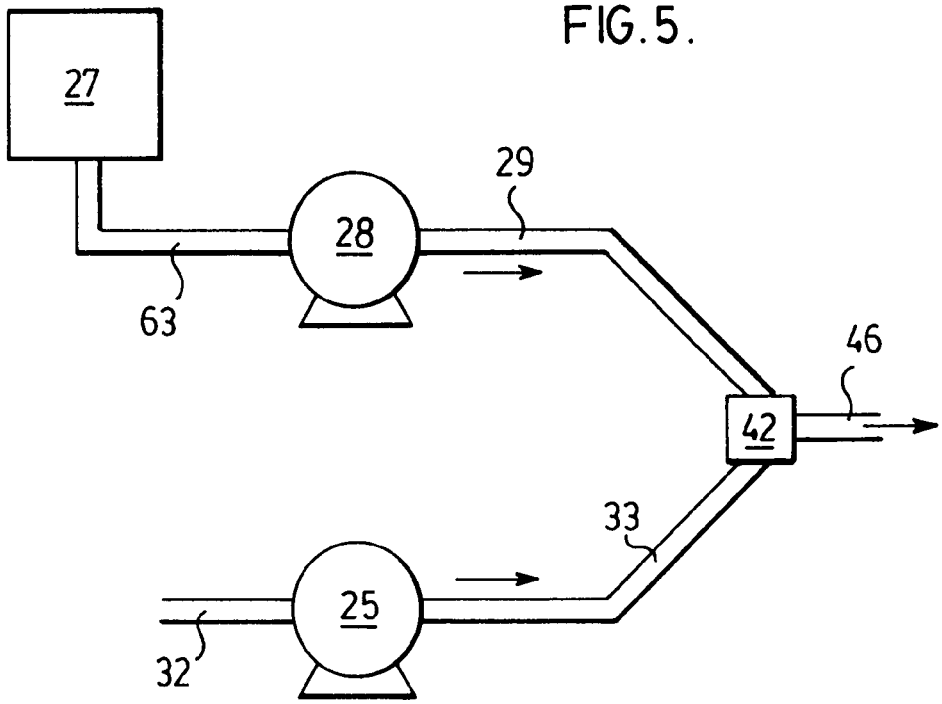
FIG. 5 is a schematic flow chart of the dispenser of FIG. 1 particularly showing the air pump and the liquid soap pump.

The electrical outlet 26 is preferably hardwired to a conventional 120 or 220 volt A/C power supply. The soap dispenser 24 comprises, as seen in FIG. 5, a reservoir 27 for liquid soap and an electric liquid pump 28 to dispense soap received from the reservoir 27 via soap input conduit 63 to a soap liquid feed tube 29 which extends from the liquid pump 28 to the soap dispensing spout 16. The reservoir 27 is adapted to have its liquid soap replenished when depleted.

The automatic soap dispenser 24 receives power from a 12 volt transformer 30 plugged into the outlet 26 and connected via a power input wire 31 to the soap dispenser 24.

The air pump 25 has an inlet 32 to receive atmospheric air. The air pump 25 pumps air from the air pump to an air feed tube 33 which extends from the air pump 25 to the soap dispensing spout 16. The air pump 25 is controlled and powered by a power input wire 35 extending from the soap dispenser 24 to the air pump.

Figure 3:
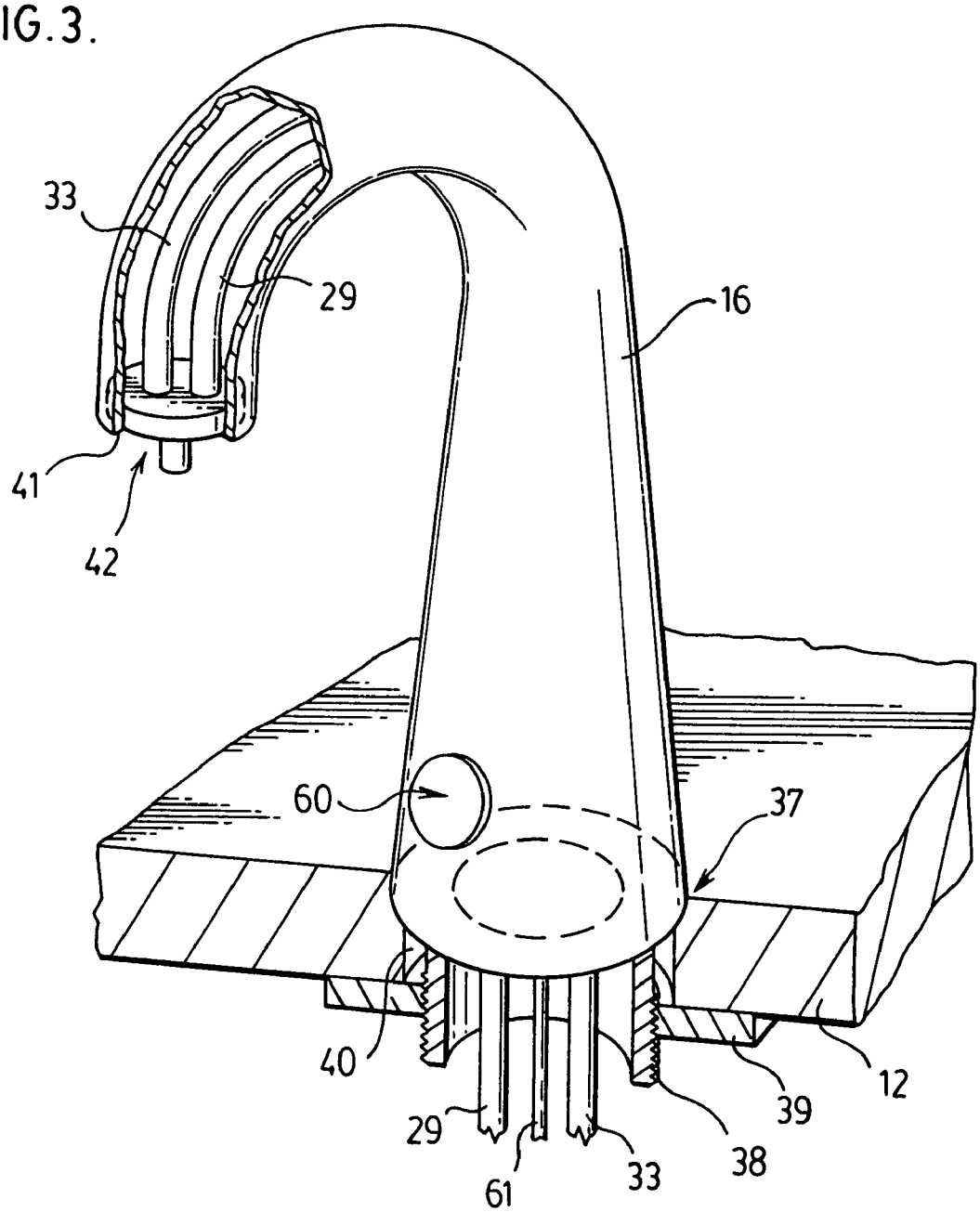
FIG. 3 is a schematic pictorial view of the soap dispenser spout of FIG. 2.

As best seen in FIG. 3, the soap dispensing spout 16 comprises a hollow tube having secured at a lower end 37 a small diameter inlet tube 38 to extend downwardly through an opening 40 in the countertop 12. The inlet tube 38 carries external threads and a locknut 39 as threaded onto the inlet tube to secure the lower end of the spout 16 to the countertop 12. An open upper end 41 the soap dispensing spout 16 carries a foam generator 42 best seen in FIG. 4. As best seen in FIGS. 2 and 3, the soap liquid feed tube 29 and the air feed tube 33 extend from the soap dispenser 24 and the air pump 25, respectively, within the storage compartment 18 and pass upwardly within the inlet tube 38 to into the inside of the hollow spout 16 and hence through the interior of the spout 16 to connect with the foam generator 42. The foam generator 42 carries an air inlet 47 for connection with the air feed tube 33 and a soap liquid inlet 48 for connection with the soap liquid feed tube 29.

The foam generator 42 has a chamber 43 and an outlet passageway 44 within which a foaming member 45 is disposed. Soap from the soap liquid feed tube 24 is dispensed via the liquid soap inlet 48 directly on to the foaming member 45 at an axial central portion of the rear of the foaming member 45. An annular portion of the rear of the foaming member 45 open to the air inlet 47 inside the chamber 43 whereby air from the air inlet 47 is forced to enter the rear of the foaming member 45 about the central portion which receives the soap liquid.

Liquid soap and air mix in the foaming member 45 and are forced as foamed soap out of an outlet side of the foaming member 45 through an exit opening 46.

A preferred foaming member 45 comprises an open cell sponge. Various other forms of foaming members or membranes may be used including, for example, a porous ceramic disc or a screen fabricated of plastic, wire or cloth material. A sponge or screen useful as a foaming member 45 preferably has small apertures though which air and liquid soap may be passes to aide foam production by causing turbulent flow through the small pores or apertures of the foaming member.

Figure 4:
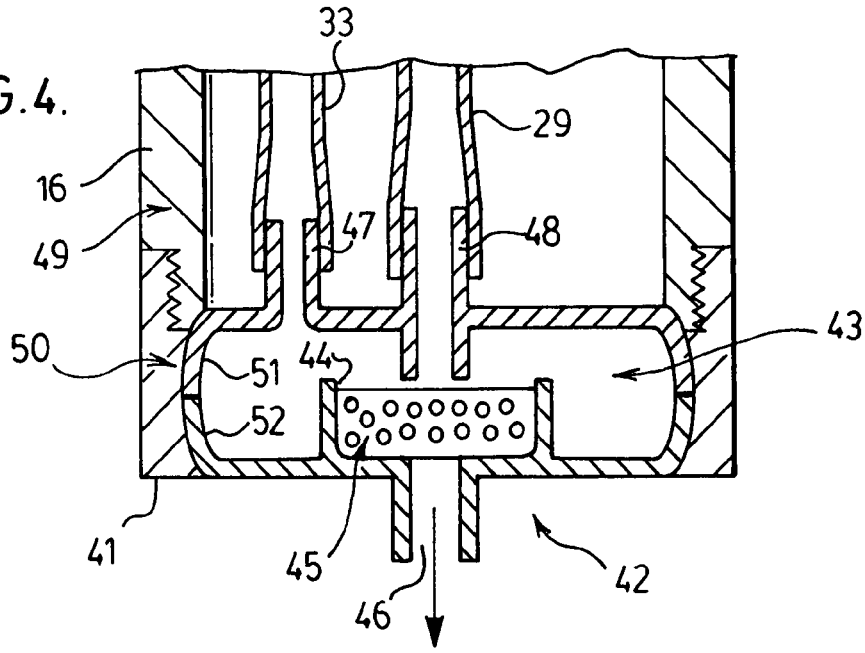
FIG. 4 is a schematic cross-sectional view of a foam generator provided within the spout shown in FIG. 3.

Referring to FIG. 4, the upper open end 41 of the soap dispensing spout 16 comprises a threaded ring 50 which is threadably received onto the tube 16 removably clamping the foam generator 42 between the ring 50 and a threaded stub end 49 of the spout 16. The generator 42 comprises an inner half 52 and an outer half 53 which sandwich the foaming member 45 therebetween. By removal of the ring 50, the two halves 52 and 53 of the generator 42 and the foaming member 45 may be removed and separated for replacement and change of the foaming member 45. Alternately, a complete new generator 42 may be inserted.

The spout 16 carries a sensor mechanism 60 which senses the presence of a user's hand proximate the spout 16 and suitably activates the soap dispenser 24 and air pump 25, preferably, simultaneously to pump soap liquid and air to the foam generator 42 and, hence, dispense foamed soap.

A sensor communication wire 61 extends from the sensor mechanism 60 internally through the spout 16 and out its inlet tube 38 to connect with the soap dispenser 24. The wires 61 extend from the sensor 60 internally of the spout 16 down through the countertop 12 in the inlet tube 38 and via the compartment 18 to the dispenser unit 24.

The soap dispenser 24 may preferably comprise an automated fluid dispenser of the type disclosed in U.S. Pat. No. 5,836,482 to Ophardt et al. issued Nov. 17, 1998, the disclosure of which is incorporated by reference. The sensor mechanism 60 may preferably comprise an emitter to emit radiation preferably infrared light and a sensor to sense light reflected from a users hand. Many touchless activation mechanisms are known and many suitable preferred mechanisms utilize infrared light.

Preferably, as in the applicant's U.S. Pat. No. 5,836,482, when fluid in a reservoir 27 is depleted, the entire reservoir 27 is removed from the dispenser 24 and replaced by a replacement reservoir 27 full of fluid. Preferably, the replacement reservoir 27 carries a replacement pump and with replacement of the reservoir 27, the pump is at the same time replaced. Coupling of the reservoir 27 also involves coupling of the new replacement pump to a motor to drive the pump which motor is a permanent part of the dispenser 24. As well, in coupling a replacement dispenser 27 to the dispenser 24 incorporating a new replacement pump, an outlet for the pump is connected to the soap liquid feed tube 29. In this manner, a new replacement liquid pump 28 is provided with each replacement of the reservoir 27. In contrast, the air pump 25 preferably may be permanent and not replaced.

The soap dispenser 24 preferably provides the reservoir 27, the liquid pump 28 and a control mechanism therefore within a unitary housing. While the preferred embodiment illustrated in FIG. 2 shows the air pump 25 as being a separately mounted element, the air pump 25 may also be incorporated as part of the soap dispenser 24 as preferably internally within its housing.

In the preferred embodiment illustrated, the soap dispenser 24 is a commercially available touchless soap dispenser modified only to receive input from the sensor 60 on the spout 16 rather than a sensor on the soap dispenser 24 itself. Such known dispensers have various control circuitry to control the dispensing of allotments of liquid soap. In the preferred embodiment, the control mechanism to control operation of the liquid pump also provides for simultaneous activation of the air pump when the liquid pump is operated and therefore without the need for substantial modification to the control system for the known soap dispenser.

Preferred operation in accordance with the preferred invention is preferably such that when a user's hand is sensed by the sensor 60, both the air pump 25 and the liquid soap pump 24 are activated and both dispense for a fixed period of time to dispense an allotment of foamed soap. In accordance with one manner of operation, the liquid pump may be stopped for a brief period of time before operation of the air pump is stopped such that during the time that only the air pump is operated, the flow of air assists in flushing soap liquid from the foam generator 42 and particularly from the foaming member 45. As well if desired, operation may be arranged with the liquid pump 28 to commence operation shortly before operation of the air pump 25.

While the preferred embodiment illustrates the air pump 25 as receiving power from and being controlled by the soap dispenser 24, it is to be appreciated that the air pump 25 could have its own power supply such as a separate transformer, and could have its own control system.

While the preferred embodiment illustrates the foamed soap dispenser as being operated touchlessly, it is to be appreciated that activation of the air pump 25 and liquid pump 28 may be accommodated merely by a simple manually operated on and off switch such as with the sensor 60 being a switch button carried on the spout 16.

As a power supply, it is preferred to provide a permanent power supply as via a transformer 30. However, it is to be appreciated that the transformer could be replaced by batteries.

The preferred embodiment illustrates a sink side foamed soap dispenser. It is to be appreciated that a modified form of the spout 16 could be mounted to the wall 13 adjacent the sink 14 rather than to the countertop 12 as illustrated.

The foamed soap dispenser in accordance with the invention is preferably mounted at least proximate a sink 14, however, this to is not necessary and it would be possible to mount the foamed soap dispenser as, for example, by a doorway away from a sink in the situation where the liquid to be foamed may comprise a liquid which is not to be washed from a person's hands by water but might be, for example, a cleaner and disinfectant which will be absorbed or evaporate without the need to be washed off, or a hand cream, sun block, insect repellent or the like which may be desired to be foamed. Similarly, the liquid may be a food product such as cream, milk, syrups and the like which may be desired to be dispensed as a foamed liquid into a vessel such as a coffee cup held near the spout.

The preferred embodiment of FIGS. 1 to 5 illustrates a cleaning station with a single sink 14 and a single faucet 15 and a single soap spout 16. It is to be appreciated in many washrooms a number of sinks and spouts may be provided. Similarly, in other dispensing situations a plurality of spouts and/or foam generators may be desired. It is preferred to have a separate dispensing unit comprising an air pump and a liquid pump for each of the spouts although a plurality of spouts 16 may be connected to a single air pump or a single liquid pump.

Figure 6:
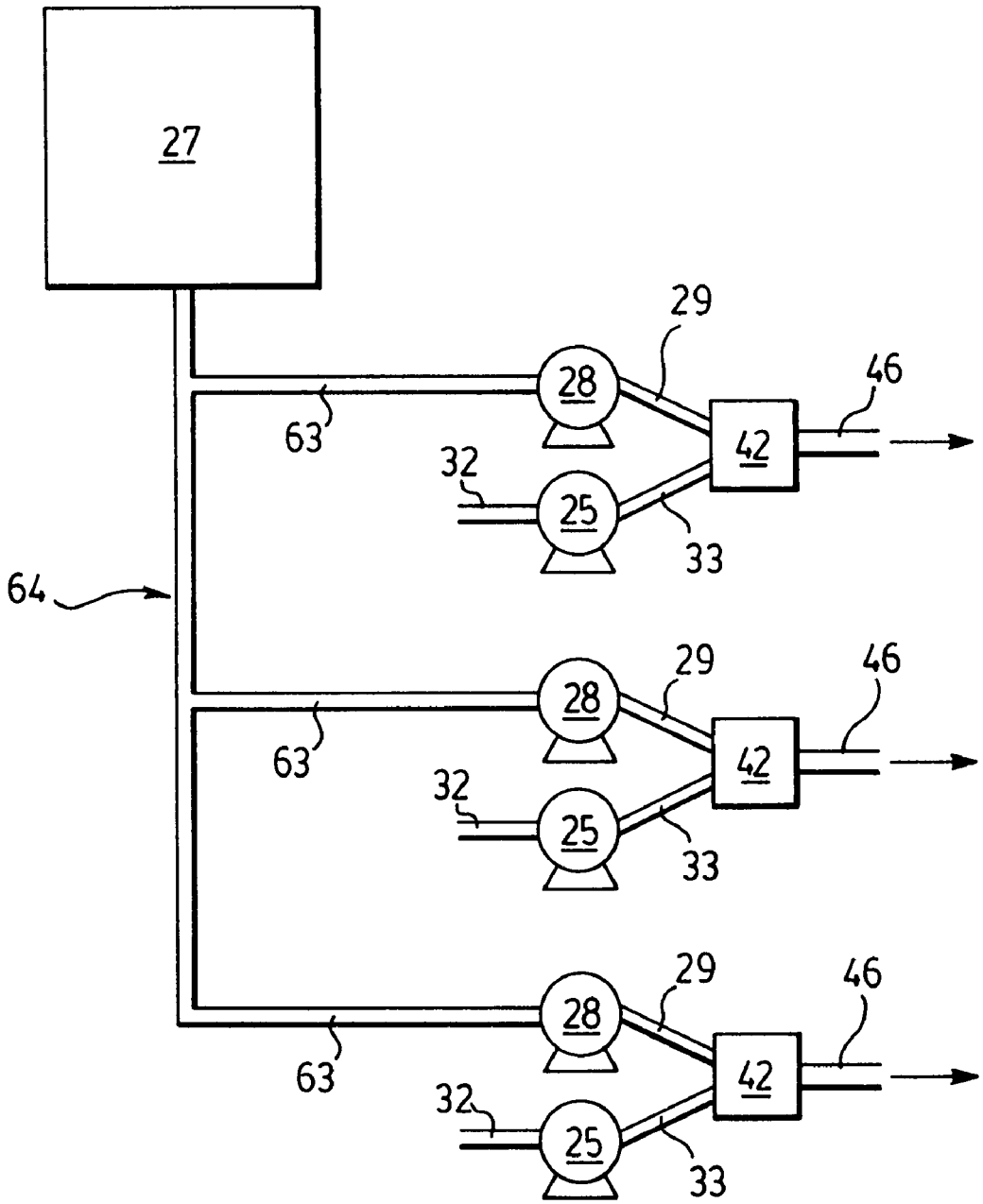
FIG. 6 is a schematic flow chart similar to FIG. 5 but showing dispensing to multiple soap spouts.

FIG. 6 illustrates an embodiment in which a single reservoir 27 is connected by a distribution manifold 64 to a plurality of liquid input conduits 63 with each conduit 63 leading to a separate liquid pump 28 which has an associated separate air pump 25 for dispensing foam from their respective foam generator 42 with each foam generator 42 to be located in a separate spout.

In FIG. 6, the single reservoir 27 may provide soap liquid to spouts 16 at a number of different sinks 14. The distance between the reservoir 27 and the spout 16 at each sink 14 can be substantial, for example, in a range of 1 to 10 meters, more preferably not greater than about 5, more preferably 3 meters, to minimize the size of the liquid pump 28 and the length of the liquid feed tube 29. Preferably, the liquid pump 28 is as close to the reservoir 27 as possible preferably within 1 meter or, more preferably, within ½ meter. The air pump 25 for each spout may be located proximate the reservoir 27 and/or liquid pump 28, however, a preferred configuration is with the air pump 25 proximate the spout 16, preferably within 1 or 2 meters of the spout 16.

Figure 7:
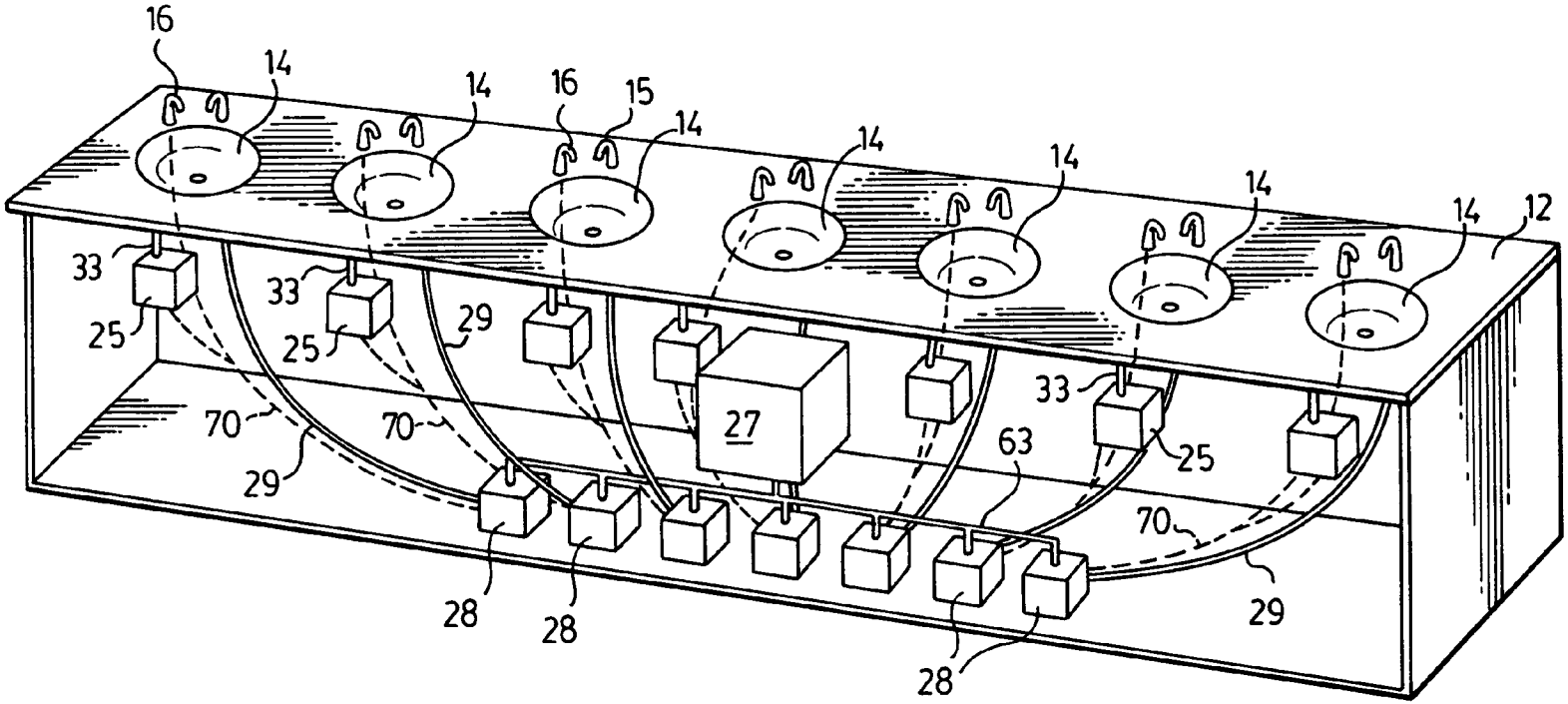
FIG. 7 is a pictorial view of a washroom counter mounted sink with a plurality of foamed soap dispensers in accordance with the second embodiment of this invention.

Reference is made to FIG. 7 which illustrates a bank of seven sinks 14 mounted in a countertop 12 with each sink 14 having a water faucet 14 and a soap spout 16. FIG. 7 schematically illustrates a central reservoir 27 with a distribution manifold 64 distributing soap liquid to seven liquid pumps 28 which, via respective liquid feed tubes 29, deliver soap liquid to their respective seven soap spouts 16. The liquid pumps 28 are located closely adjacent the reservoir 27. Seven air pumps 25 are provided with one for each spout 16. Each air pump 5 is located under the countertop 12 closely adjacent its respective spout 16.

Wiring for power or communication between the sensor switch 60 on each spout 16, the air pump 25 and/or the liquid pump 28 may be routed to be carried in individual wares such as 61 and 35 in FIG. 2, however, may in the context of FIG. 7 comprise a single conduit 70 shown in dashed lines in FIG. 7 extending between the air pump 35 and the liquid pump 28 or a controller for the liquid pump 28 to facilitate ease of installation, possibly with the conduit 70 branched with a branch conduit to go to the sensor or switch 60.

The embodiment of FIG. 7 shows remote location of the reservoir 27, liquid pumps 28 and air pumps 25 under a countertop. In other arrangements with sink side spouts or wall mounted spouts, the reservoir, liquid pumps and air pumps may be mounted as in a service room behind a wall near where the spouts are mounted.

In accordance with another aspect of the present invention, the dispenser system is adapted for use either as a dispenser to dispense a foam liquid or as a dispenser for dispensing liquid without foaming in which dispenser system is preferably readily convertible between foaming and non-foaming operations.

Figure 8:
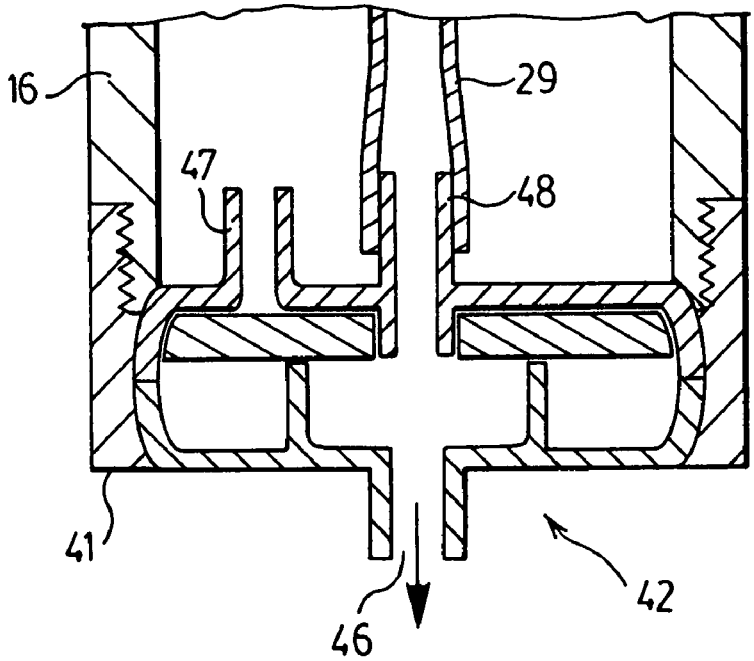
FIG. 8 is a view identical to FIG. 4 with the foam generator of FIG. 4 modified for only liquid flow.

Reference is made to FIG. 8 which shows the soap dispenser spout of FIG. 4, however, with the foaming member 45 removed and an annular washer-like block plug 56 placed inside the generator 42 between the two generator halves 52 and 53 such that the plug 56 blocks communication from the air inlet 47 to the outlet and merely permits fluid flow from the fluid inlet 48 to the outlet 46. In FIG. 8, the air inlet 47 does not have an air feed tube attached.

Figure 9:
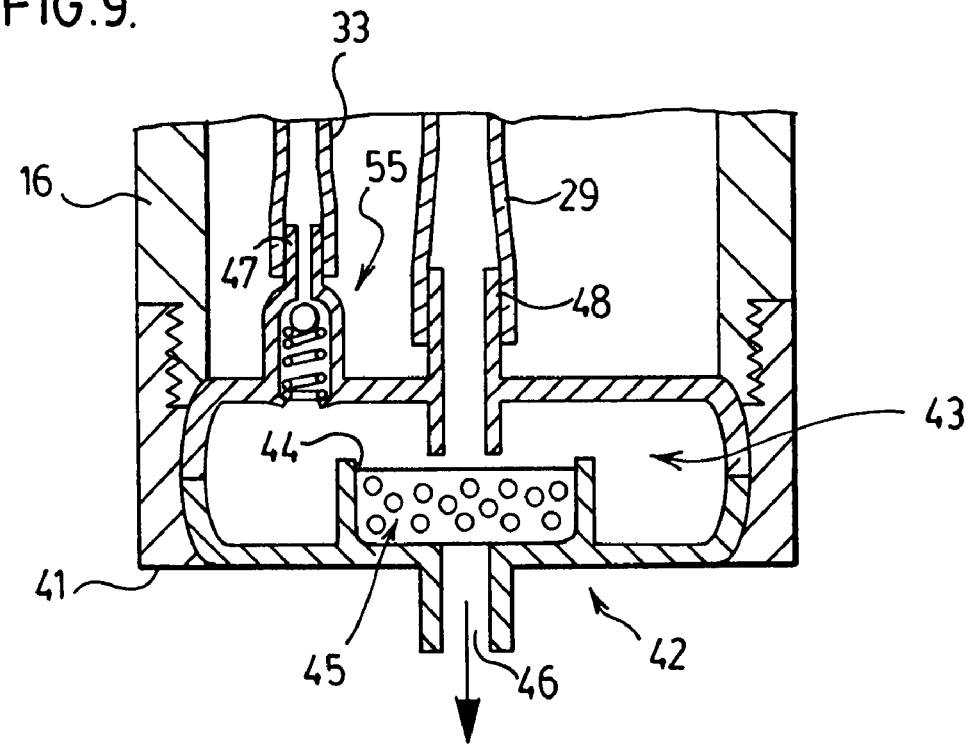
FIG. 9 is a view similar to FIG. 4 but with the foam generator modified to have a one-way air inlet valve.

Reference is made to FIG. 9 which shows a soap dispensing spout identical to that in FIG. 4, however, with a one-way valve 55 provided in the air inlet 47 serving to prevent liquid and/or foam which may be inside the generator 42 from flowing into the air feed tube 33. The one-way valve 55 is schematically shown as having a spring bias, a ball to close the air inlet 47 to backflow from the generator 42.

In this regard, the spout 16 is, as shown in FIG. 3, a hollow tube whose lower end 37 is accessible via inlet tube 38 and whose upper end 41 is accessible with removal of the threaded ring 50 and the foam generator 42. An installed spout 16 is thus adaptable for removal and/or change of the generator 42. As well, when the generator 42 is removed, it is possible to change the configuration of the generator 42 as, for example, from a foaming configuration shown in FIG. 4 to a non-foaming configuration shown in FIG. 8. Additionally, with the generator 42 removed or with installation of a new generator 42, the generator 42 may initially be installed without an air feed tube 33 connected to the air inlet 47 as is illustrated in FIG. 8 for use for dispensing liquid without foaming. Subsequently, if it is desired to convert the generator 42 for foam dispensing, the generator 42 may be removed and reconfigured to permit foaming and an air feed tube 33 may be passed through the spout 16 and suitably coupled to the air inlet 42 of the generator 42. Of course, in the context of the embodiment of the generator illustrated in FIG. 9, the provision of the one-way valve 55 permits a simpler conversion between dispensing with foaming to dispensing without foaming merely by operation of the system so as to provide or not provide air through the air feed tube 33 at the time of dispensing. When merely dispensing soap liquid which is not to be foamed, the foaming member 45 is not required, a foaming member 45 may be selected which does not significantly impede dispensing of soap liquid alone. Thus, in accordance with one aspect of the invention, the system is configured so as to be operative for feeding of both liquid and air to the generator 42, however, with the system controlled so as to merely pump liquid without pumping the air so as to dispense unfoamed liquid or to pump both liquid and air so as to dispense foamed liquid.

In accordance with another aspect of the invention, the system is adaptable for initial installation without providing an air pump or an air feed tube. Subsequently, the system may be readily retrofitted by supplying an air pump, coupling it to the controller and power supply for the liquid pump, supplying an air feed tube from the air pump to the spout 16 and suitably configuring, if necessary, the generator to receive air and dispense foam.

The system may first be configured for dispensing without foaming as by adopting the configuration of FIG. 8 and providing the system without an air pump or with an air pump rendered inoperative. Subsequently, to convert to a foaming dispensing, the generator may be removed, its halves opened to replace the blocking plug 56 by a foaming member 45 with the generator removed and air feed tube may be passed through the spout 16 and coupled to the generator. An air pump may be provided and coupled to the generator. An air pump may be provided and coupled to the control mechanism and a power supply. If an air pump has already been provided, then it may be actuated.

In accordance with the embodiment of FIG. 9 having a one-way valve 55 in the air inlet, it is merely necessary to render the air pump operative or to provide an air pump.

The sensor 60 on the spout 16 in a preferred embodiment would be operative to provide for dispensing and need not be altered where the dispensing is to be dispensing a foamed liquid or non-foamed liquid. As an optional configuration, a selector switch could be provided to a user such as a second switch which could be activated so as to change the mode of operation from foaming to non-foaming use. An air pump may be initially provided, however, not connected as with the second switch rendering it inactive.

Figure 10:
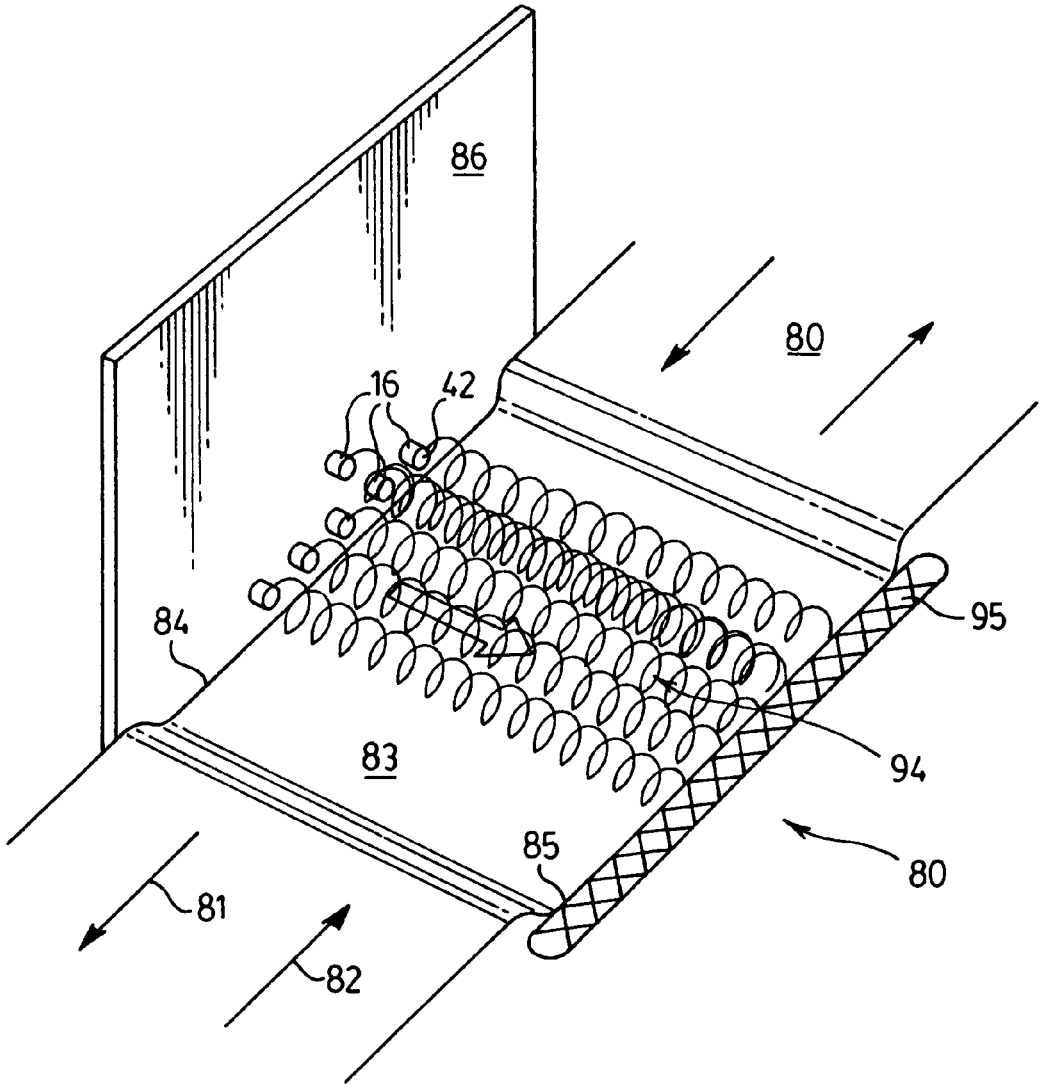
FIG. 10 is a schematic pictorial view of a foam curtain foaming apparatus in accordance with the present invention.
Figure 11:
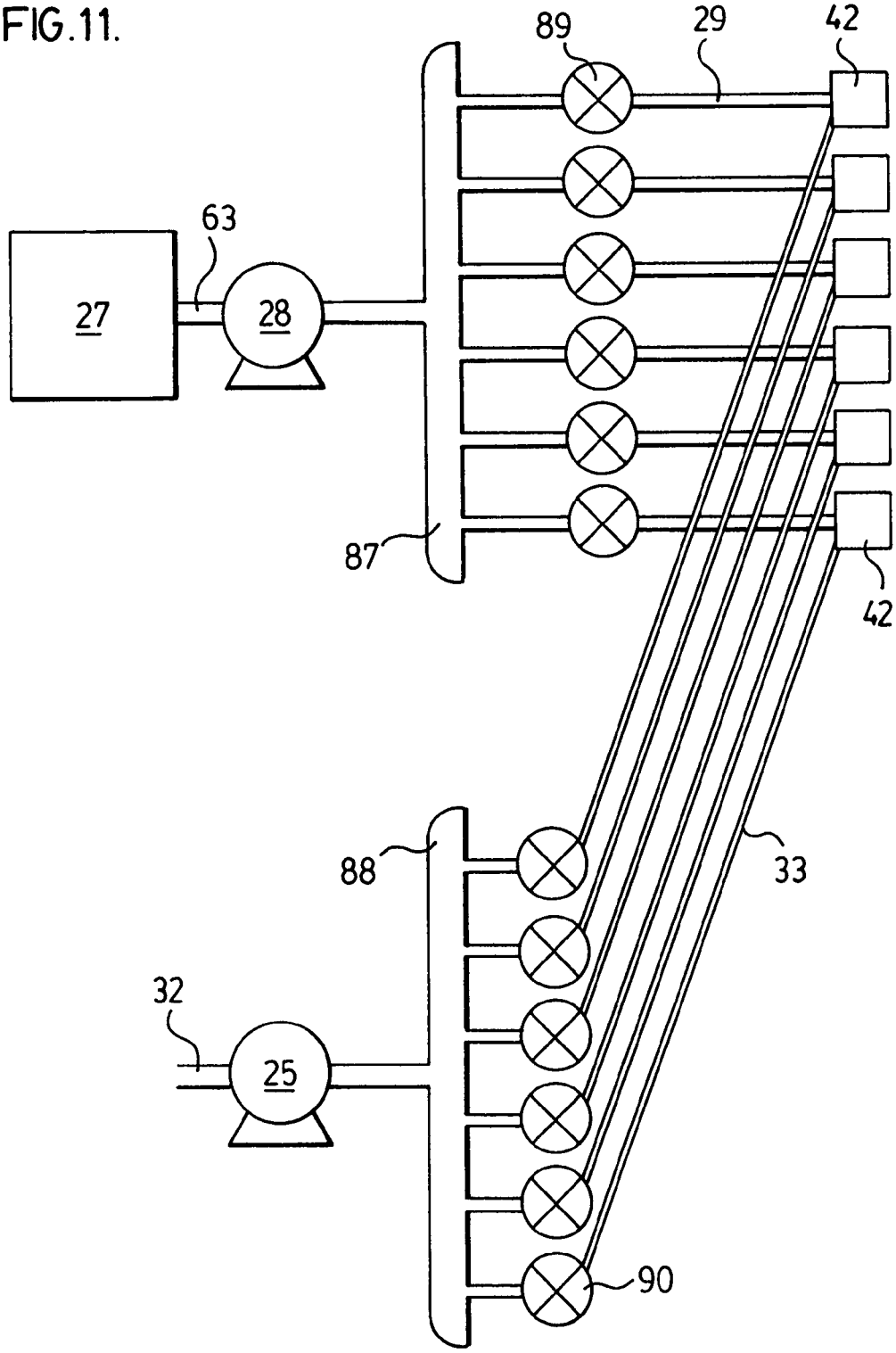
FIG. 11 is a schematic flow chart of the apparatus of FIG. 10.

Reference is made to FIGS. 10 and 11 which illustrate a continuous foam generation system in accordance with another aspect of the present invention. As seen in FIG. 10, a floor passageway generally indicated 80 is provided along which personnel may walk and/or wheeled vehicles such as dollies or forklifts may be pushed or driven as in the directions indicated by arrows 81 and 82. A slightly depressed trough 83 extends transversely across the passageway 80. The trough 83 is inclined from a first side 84 to a second side 85. A plurality of foam dispensing spouts 16 are arranged along the first side 84, shown as mounted in an adjacent wall 86. The spouts 16 are similar to the spout 16 in the embodiment illustrated in FIGS. 1 to 5 and carry removable and replaceable foam generators 42 which may be the same as that shown in FIGS. 3, 4, 8 and 9.

The spouts 16 are shown to be arranged in an array which may be partially horizontally linear and partially vertically stacked. An objective is to provide for continuous foam generation such that a foam curtain or a layer of foam 94 exists at all time continuously across the passageway 80 so as to assist, for example, in disinfecting a person's shoes as they may walk through the passageway from one area to another as, for example, in food processing plants. Foam 94 from the spouts 16 moves under gravity transversely across the trough 83 to a floor drain 95.

FIG. 11 shows one arrangement for feeding liquid and air to the spouts 16 and their foam generators 42 of FIG. 10. As shown, a single reservoir 27 of liquid to be dispensed feeds liquid via a feed line 63 to a single liquid pump 28 which continuously pumps the liquid to a liquid manifold 87 from which a plurality of liquid feed tubes 29 extend with one liquid feed tube 29 connecting to the liquid inlet of the generator 42 for each spout. A single air pump 25 is shown to deliver air to an air manifold 88 from which a plurality of air feed tubes 33 extend with one air feed tube 33 connecting to the air inlet of the generator 42 for each spout. While not necessary, liquid flow adjustment valves 89 may preferably be provided between the liquid manifold 87 and the liquid inlet to each foam generator 42. Similarly, while not necessary, air flow adjustment valves 90 may be provided between the air manifold 88 and the air inlet to each generator. The flow adjustment valves 89 and 90 may be used to assist in providing for adjustment of the liquid flow and air flow through each generator 42. Rather than have a single liquid pump or single air pump, as illustrated in FIG. 11, the arrangements as shown in FIGS. 5, 6 or 7 could be adopted to deliver liquid and air to each generator in FIG. 10. Since the generators are to dispense foam substantially continuously, there is no need to provide for the intermittent sensor 60 as in the embodiment of FIGS. 1 to 7.

While the invention as been described with reference to a preferred embodiment, many modifications and variations will not occur to persons skilled in the art. For definition of the invention reference is made to the following claims.

I claim:

1. A convertible dispenser spout for dispensing either liquid or a foamed mixture of air and liquid, the spout comprising:

a chamber forming member defining a chamber therein having an interior, an exit port, an air inlet port adapted to be connected to a source of air above atmospheric pressure, and a liquid inlet port adapted to be connected to a source of liquid above atmospheric pressure, the chamber forming member comprising an inner portion and an outer portion, the outer portion removably coupled to the inner portion for removal to access the interior of the chamber, the exit port carried on the outer portion, the air inlet port and the liquid inlet port carried on the inner portion, a foam producing member adapted to be removably received in the interior of the chamber across the exit port by being sandwiched between the inner portion and the outer portion when the inner portion and the outer portion are coupled together, the foam producing member being insertable into and removable from the chamber when the inner portion and an outer portion are uncoupled from each other, the foam producing member adapted when the liquid and the air are simultaneously passed therethrough to produce foam, a valve mechanism disposed across the air inlet port adapted to assume either a closed configuration in which the valve mechanism blocks flow through the air inlet port and an open configuration in which the valve mechanism permits flow through the air inlet port, the valve mechanism selected from: (a) a one way valve resiliently biased to assume the closed configuration and which assumes the open configuration when the air at a pressure above the pressure in the chamber is applied to the air inlet port, and (b) a stop member adapted to be removably received in the interior of the chamber across the air inlet port wherein in the closed configuration the stop member is retained in the chamber across the air inlet port by being sandwiched between the inner portion and the outer portion when they are coupled together and in the open configuration the stop member is not present in the chamber, the stop member being insertable into and removable from the chamber when the inner portion and an outer portion are uncoupled from each other.

2. A convertible dispenser spout as claimed in claim 1 wherein the chamber is generally annular about the liquid inlet port which is centrally of the inner portion and the exit port which is centrally of the outer portion, the air inlet port is on the inner portion radially outwardly of the liquid inlet port.

3. A convertible dispenser spout as claimed in claim 2 wherein valve member comprises the stop member, the stop member comprises an annular seal member radially outwardly of the liquid inlet port.

4. A convertible dispenser spout as claimed in claim 3 wherein a central exit tube extending from the exit port inwardly into the interior of the chamber toward the inner portion to a distal end, the foam producing member received inside the central exit tube.

5. A convertible dispenser spout as claimed in claim 4 wherein a central inlet tube extending from the liquid inlet port inwardly into the interior of the chamber toward the outer portion to a distal end.

6. A convertible dispenser spout as claimed in claim 5 wherein the distal end of the inlet tube engages the foam producing member urging the foam producing member into the outer portion.

7. A convertible dispenser spout as claimed in claim 3 wherein the annular seal member having a central opening therethrough, when received in the interior of the chamber sandwiched between the inner portion and the outer portion the annular seal member urged into the air inlet port to prevent flow therethrough yet permitting flow through the interior of the chamber from the liquid inlet port to the exit port via the central opening.

8. A convertible dispenser spout as claimed in claim 7 wherein a central inlet tube extending from the liquid inlet port inwardly into the interior of the chamber toward the outer portion to a distal end, the central inlet tube extending through the central opening of the annular seal member.

9. A convertible dispenser spout as claimed in claim 8 wherein the distal end of the outlet tube engages the annular seal member urging the annular seal member into the inner portion.

10. A convertible dispenser spout as claimed in claim 8 wherein a central exit tube extending from the exit port inwardly into the interior of the chamber toward the inner portion to a distal end, the foam producing member received inside the central exit tube.

11. A convertible dispenser spout as claimed in claim 2 wherein a central exit tube extending from the exit port inwardly into the interior of the chamber toward the inner portion to a distal end, the foam producing member received inside the central exit tube.

12. A convertible dispenser spout as claimed in claim 11 wherein a central inlet tube extending from the liquid inlet port inwardly into the interior of the chamber toward the outer portion to a distal end.

13. A convertible dispenser spout as claimed in claim 12 wherein the distal end of the inlet tube engages the foam producing member urging the foam producing member into the outer portion.

14. A convertible dispenser spout as claimed in claim 1 wherein the spout includes a tubular member having at a threaded distal dispensing end a threaded ring removably threadably received thereon, with the inner portion and the outer portion mounted on the distal dispensing end of the tubular member by the threaded ring with the threaded ring urging the outer portion into the inner portion.

15. A convertible dispenser spout as claimed in claim 14 wherein the tubular member having a passageway therethrough via which an air conduit may pass for connection to the air inlet port and via which a liquid conduit passes for connection to the liquid inlet port.

* * * * *